US008807103B2

(12) United States Patent
Hoppe et al.

(10) Patent No.: US 8,807,103 B2
(45) Date of Patent: Aug. 19, 2014

(54) CAMSHAFT ADJUSTER

(71) Applicant: Schaeffler Technologies AG & Co. KG, Herzogenaurach (DE)

(72) Inventors: Jens Hoppe, Erlangen (DE); David Kohler, Egloffstein (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/742,567

(22) Filed: Jan. 16, 2013

(65) Prior Publication Data

US 2013/0199467 A1 Aug. 8, 2013

(30) Foreign Application Priority Data

Feb. 2, 2012 (DE) ..... 10 2012 201 573

(51) Int. Cl.
*F01L 1/34* (2006.01)
*F01L 1/344* (2006.01)

(52) U.S. Cl.
CPC ..... *F01L 1/3442* (2013.01); *F01L 1/344* (2013.01)
USPC ..... 123/90.17; 123/90.15

(58) Field of Classification Search
CPC ..... F01L 1/3442; F01L 1/344; F01L 2001/34453; F01L 2001/34433
USPC ..... 123/90.15, 90.17, 90.31
See application file for complete search history.

(56) References Cited

U.S. PATENT DOCUMENTS 6,971,353 B2 * 12/2005 Heinze et al. ..... 123/90.17
2002/0043230 A1 * 4/2002 Kinugawa ..... 123/90.15

FOREIGN PATENT DOCUMENTS

DE 19817319 10/1999
WO 2010015541 2/2010

* cited by examiner

*Primary Examiner* — Zelalem Eshete
(74) *Attorney, Agent, or Firm* — Volpe and Koenig, P.C.

(57) ABSTRACT

A central valve (1) of a camshaft adjuster (2), which has an additional hydraulic fluid passage, which is independent of the other hydraulic fluid passages to the other ports and does not communicate therewith.

10 Claims, 4 Drawing Sheets

CAMSHAFT ADJUSTER

INCORPORATION BY REFERENCE

The following documents are incorporated herein by reference as if fully set forth: German Patent Application No.: 102012201573.6, filed Feb. 2, 2012.

FIELD OF THE INVENTION

The invention relates to a camshaft adjuster.

BACKGROUND OF THE INVENTION

Camshaft adjusters are used in internal combustion engines to vary the timings of the combustion chamber valves in order to be able to vary the phase relation between a crankshaft and a camshaft in a defined angular range between a maximum advanced and a maximum retarded position. Adapting the timings to the current load and engine speed reduces consumption and emissions. For this purpose, camshaft adjusters are integrated into a drive train via which a torque is transmitted from the crankshaft to the camshaft. This drive train can be designed as a belt, chain or gear drive, for example.

In the case of a hydraulic camshaft adjuster, the output element and the input element form one or more pairs of opposing pressure chambers, which can be supplied with hydraulic fluid. The input element and the output element are arranged coaxially. By filling and emptying individual pressure chambers, a relative motion between the input element and the output element is produced. The spring acting for rotation between the input element and the output element urges the input element in a preferential direction relative to the output element. This preferential direction can be the same as or opposed to the direction of rotation.

One type of hydraulic camshaft adjuster is the vane cell adjuster. Vane cell adjusters have a stator, a rotor and a drive wheel with external teeth. The rotor is designed as an output element, generally in a manner which allows it to be connected for conjoint rotation to the camshaft. The input element comprises the stator and the drive wheel. The stator and the drive wheel are connected to one another for conjoint rotation or, as an alternative, are formed integrally with one another for this purpose. The rotor is arranged coaxially with and within the stator. The rotor and the stator, with their radially extending vanes, define oppositely acting oil chambers, which can be supplied with oil pressure and allow a relative rotation between the stator and the rotor. The vanes are either formed integrally with the rotor or the stator or are arranged as "inserted vanes" in grooves provided for that purpose in the rotor or the stator. Moreover, vane cell adjusters have various sealing covers. The stator and the sealing covers are secured to one another by a plurality of screw connections.

Another type of hydraulic camshaft adjuster is the axial piston adjuster. In this case, a sliding element is moved axially by oil pressure, producing a relative rotation between an input element and an output element by way of helical teeth.

WO 2010/015541 A1 shows a camshaft adjuster having a central valve. The central valve has two inlet ports, wherein one is arranged coaxially with the central valve and the other is arranged radially with respect to the central valve. The inlet ports are designed as bores. The central valve furthermore has two working ports on the outer circumference, which are situated opposite the hydraulic fluid ducts leading to the pressure chambers. Arranged on the side remote from the camshaft is the tank port for returning hydraulic fluid to be displaced into the reservoir of the internal combustion engine.

DE 198 17 319 A1 shows a central valve of a camshaft adjuster. The inlet port is arranged on the outer circumference of the central valve. The inlet port is flanked by the two working ports in the axial direction. The tank port is situated on the end of the central valve adjacent to the camshaft and opens into a radial bore in the camshaft.

SUMMARY OF THE INVENTION

It is the object of the invention to provide a central valve of a camshaft adjuster which allows better control of the hydraulic camshaft adjuster.

This object is achieved by a central valve of a camshaft adjuster with one or more features of invention.

The central valve according to the invention for a camshaft adjuster has an outer housing and a control piston arranged within the outer housing, wherein the central valve has an inlet port, a plurality of working ports and a tank port, wherein the control piston controls the hydraulic fluid flow to the working ports, wherein the central valve has an independent passage according to the invention for a separate hydraulic fluid flow, which does not communicate with any of the abovementioned ports.

The central valve is suitable especially for controlling a hydraulic camshaft adjuster and is arranged coaxially with the axis of symmetry or axis of rotation of the camshaft adjuster or the camshaft. In addition, the central valve is positioned within the camshaft adjuster, i.e. the central valve and the camshaft adjuster are mounted one on top of the other in the radial direction. As an option, the camshaft can be arranged between the camshaft adjuster and the central valve.

The control piston is situated within the outer housing of the central valve. The control piston can be moved in the axial direction and is guided by the outer housing. The control piston can thus be positioned in any axial position relative to the outer housing. Positioning is accomplished by a central magnet, the actuating pin of which makes contact with one end of the control piston and can move the control piston. Through the axial positioning of the control piston, the various ports of the central valve are connected to one another and isolated from one another hydraulically and can thus communicate with one another or not. To carry the hydraulic fluid between the ports, the control piston and the outer housing are provided with openings, e.g. grooves and/or bores. The control piston has control edges which, together with the edges of the openings of the outer housing, control throughflow. The control edges themselves are the edges of the respective openings of the control piston. To control the throughflow, the edges of the openings of the outer housing and the control edges are positioned relative to one another in such a way that an opening of the outer housing lies substantially opposite an opening of the control piston and forms a throughflow area for the hydraulic fluid that can be varied by virtue of the ability to position the control piston axially.

According to the invention, the central valve has an independent passage for a separate hydraulic fluid flow, which does not communicate with at least one of the abovementioned ports. It is thus also possible to provide for a plurality of the abovementioned ports not to communicate with the independent passage according to the invention. In this specific case, the independent passage does not communicate with any of the abovementioned ports. The abovementioned ports comprise at least one inlet port, at least two working ports and at least one tank port.

This ensures that the independent passage can be used and operated separately from and independently of the other ports. The independent passage can thus be used as an additional hydraulic fluid duct, in particular for actuating a locking mechanism, in particular for locking in an intermediate position between "retarded" and "advanced", preferably for locking in the central position.

A locking mechanism comprises a locking piston and a locking spring. The locking mechanism is provided for blocking the relative rotation between the input element and the output element of the camshaft adjuster. The blocking action is canceled by applying pressure with hydraulic fluid counter to the force of the locking spring.

In a camshaft adjuster having more than one locking mechanism, one locking mechanism can be activated independently of the other locking mechanisms. The other locking mechanisms can be actuated via the working ports or via additional independent passages of the central valve.

In one embodiment of the invention, the passage carries the hydraulic fluid irrespective of the position of the control piston. In particular, the independent passage provides hydraulic fluid for the desired function, preferably the locking or blocking of the relative rotation between the input element and the output element, irrespective of the axial position of the control piston. The passage can thus also be formed by the control piston itself, e.g. by a coaxial bore that is not in hydraulic communication with the control edges of the control piston.

In an advantageous embodiment, the passage is formed by the outer housing. The outer housing can be the camshaft in which the control piston moves or a sleeve-shaped component of the central valve which at least partially surrounds the control piston. The passage can be introduced into the respective material of the outer housing by machining, by a defined or undefined cutting edge, primary processing methods and/or forming methods. The shape or configuration of the passage design is advantageously maintained in a reliable manner over the service life by virtue of the formation thereof on a single component. The passage can be designed as a groove, bore or flat. The throughflow cross section of the passage can have any desired shape matched to the desired throughflow behavior of the hydraulic fluid. The throughflow cross section can be made variable or constant along the direction of extension of the passage.

In a particularly preferred embodiment, the outer housing has a flat on the outer circumferential surface thereof, said flat being designed as a passage. The flat on the outer circumferential surface is very economical to produce. In this case, the outer circumferential surface can be of uniform diameter in the region of the flat or can vary in diameter, e.g. in a step shape. By use of the variable diameter, the throughflow cross section can advantageously vary along the passage in order, in this way, to form a restrictor, a nozzle shape or a diffuser shape, for example, to guide the hydraulic fluid through said passage.

In one embodiment of the invention, the central valve furthermore has an inner housing, which is arranged between the control piston and the outer housing, and the inner housing has this passage. The inner housing can advantageously have the lines leading to the various ports in a nested form in such a way that the ports can be positioned in any desired arrangement or sequence in an axial and/or circumferential orientation. For this purpose, the inner housing has a plurality of bores, grooves and/or apertures, which are designed to carry the hydraulic fluid.

In a preferred embodiment, the passage of the inner housing is designed as a groove extending in the axial direction. The groove can form a duct for carrying hydraulic fluid together with an inner circumferential surface of the outer housing or with an outer circumferential surface of the control piston. The groove can be produced by a cutting method or a non-cutting method. A non-cutting method, in particular a primary processing method, e.g. casting, is an advantageous candidate for consideration. To this end, the inner housing is preferably made of plastic.

In another embodiment of the invention, the outer circumferential surface of the outer housing has an opening, which carries hydraulic fluid to the passage of the inner housing. This opening is provided for the purpose of carrying hydraulic fluid to the corresponding port on the outer housing. Openings can be bores or apertures of any desired cross section. Thus, there is a port for the independent passage on the outer housing, guiding hydraulic fluid to a locking mechanism operated independently of the other ports, for example.

In one embodiment of the invention, the outer housing of the central valve is designed as a central screw, which can connect the camshaft adjuster to a camshaft. With a central screw designed as an outer housing, the central valve can be supplied as a unit and used to attach the camshaft adjuster to the camshaft. As an alternative, the camshaft itself may be used as an outer housing, it being possible for the camshaft adjuster to be connected to the camshaft by a nut.

In an advantageous embodiment, the central valve has a check valve, which allows the inflow of hydraulic fluid in one direction of hydraulic fluid flow and prevents it in the opposite direction. It is advantageous if the check valve is arranged in the independent passage and thus prevents return flow of hydraulic fluid in one direction.

Through the arrangement according to the invention of an independent passage in the central valve, an additional autonomous port is created, which can be used independently of the inlet port, the tank port and the working port, e.g. for a locking mechanism. This provides an interface for carrying hydraulic fluid which is decoupled from the remaining operation of the camshaft adjuster and is reliable.

BRIEF DESCRIPTION OF THE DRAWINGS

Illustrative embodiments of the invention are shown in the figures, where.

DETAILED DESCRIPTION OF THE PREFERRED EMBODIMENTS

Figure 1:
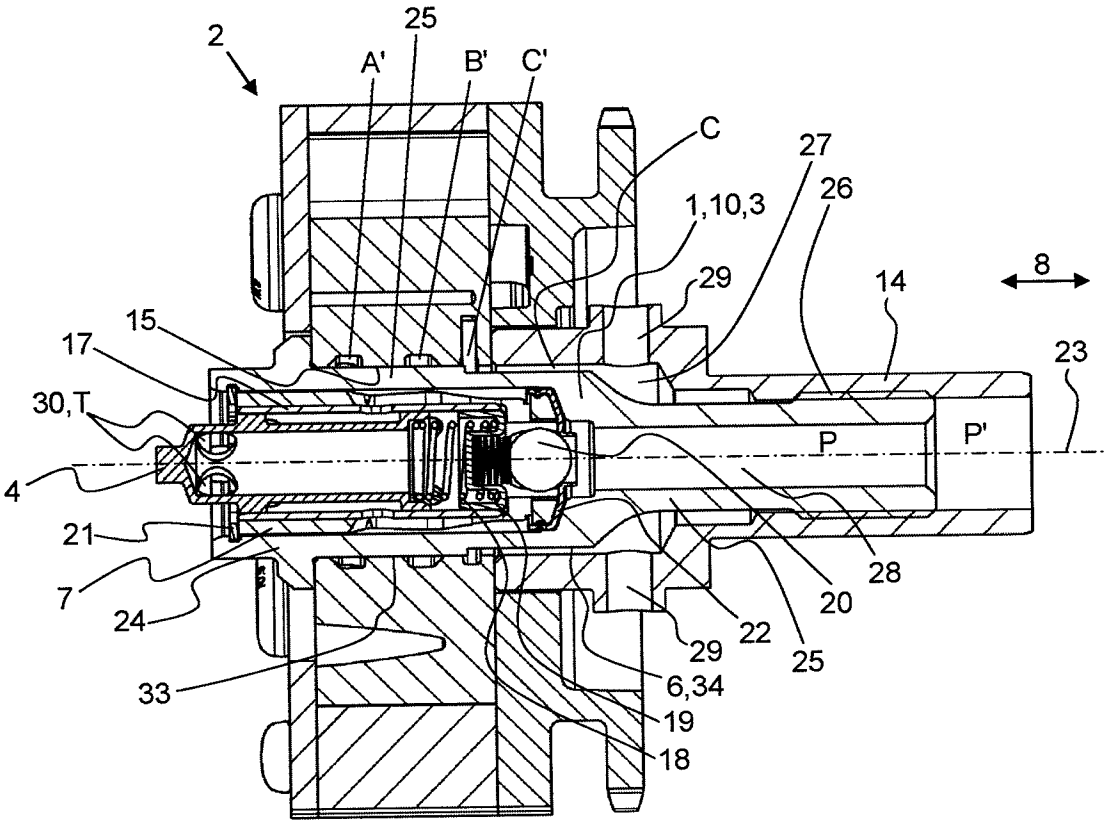
FIG. 1 shows a camshaft adjuster having a central valve according to the invention and a camshaft.

FIG. 1 shows a camshaft adjuster 2 having a central valve 1 according to the invention and a camshaft 11. The camshaft adjuster 2 is designed as a vane cell adjuster. The construction and operation are known from the prior art.

The camshaft adjuster 2 depicted in FIG. 1 has a central opening 15. The central opening 15 has three interfaces A', B' and C' on the circumferential surface thereof. Interfaces A' and B' are the working ports of the camshaft adjuster 2 and communicate with the working chambers of the camshaft adjuster 2. Interface C' is preferably provided for a locking mechanism (not shown specifically), in particular for locking in an intermediate position, preferably in a central position. The interfaces A', B' and C' are designed as encircling grooves offset relative to one another in the axial direction. In the text which follows, details will be given of the central valve 1 with the design of the independent passage C therein.

The central valve 1 comprises an outer housing 3, an inner housing 7, a guide sleeve 17, a control piston 4, a compression spring 18, a spring supporting element 19, a check valve 20, a valve seat 22 and a retaining ring 21. All the abovementioned components are arranged coaxially with one another and with the axis of rotation 23 of the camshaft adjuster 2.

The outer housing 3 is designed as a central screw 10 and has a screw head 24, a screw shank 25 and an external thread 26. Via a flange surface of the screw head 24, the camshaft adjuster 2 is clamped to the camshaft 23 in the axial direction 8 and connects all three components to one another for conjoint rotation. The camshaft 23 has a cavity 27 at least at its end adjacent to the camshaft adjuster. The cavity 27 is of rotationally symmetrical and stepped design. The camshaft 14 furthermore has a threaded portion, which is provided for engagement with the external thread 26 of the central screw 10. The central screw 10 has a cavity 28, which extends continuously from one end of the central screw 10 to the other end thereof. The screw shank 25 divides the cavity 27 of the camshaft 23 into two regions hydraulically separated from one another. The first region is provided as interface P' for the inlet port P of the central valve 1. The second region is provided especially for supplying hydraulic fluid for the independent passage C. In this illustrative embodiment, the second region is in fluid-carrying communication with radial bores 29 and can thus be supplied with hydraulic fluid, or hydraulic fluid can be discharged via said radial bores 29.

The outer circumferential surface of the screw shank 25 of the central screw 10 is of stepped design. The independent passage C of the central valve 1 is designed as an offset diameter of a step 34 of the outer circumferential surface of the screw shank 25. A substantially constant outside diameter 33, which is approximately equal to the inside diameter of the central opening 15, is provided between the step 34 of the outer circumferential surface of the screw shank 25 and the screw head 24. The independent passage C is completed by the inner circumferential surface of the cavity 27 and the inner circumferential surface of the central opening 15. There remains an annular throughflow cross section, which adjoins the second region of the cavity 27 and through which hydraulic fluid can flow. With its open side, the interface C' surrounds the independent passage C as an encircling groove, thus allowing the hydraulic fluid to be deflected from its axial flow direction, namely in the passage, by the step of the offset diameter, into a radial flow direction, namely into interface C'. In this way, the central valve 1 can carry hydraulic fluid between the radial bores 29 and interface C' without influences from the transport of hydraulic fluid between the other ports having an effect on this hydraulic fluid flow through passage C. This design in accordance with the illustrative embodiment shown is advantageously suitable for the following sequence in the axial direction 8 of the interface arrangement, beginning with the end of the central opening 15 adjacent to the camshaft:

- interface C' for the independent passage C for independent control of a locking mechanism, for example,
- interface B' for at least one working chamber which advances the timings,
- interface A' for at least one working chamber, which retards the timings.

As an alternative, interfaces B' and A' can be interchanged.

The inner housing 7, the guide sleeve 17, the control piston 4, the compression spring 18, the spring plate 19, the check valve 20 and the valve seat 22 are arranged in the cavity 28 of the central screw 10, at the screw head end. At the threaded end of the central screw 10, a central bore opens into interface P' of the camshaft 23 and thus forms the inlet port P. From the inlet port P, the hydraulic fluid passes through the check valve 20, in which the pressure which arises lifts the check valve 20 from the valve seat 22 and thus opens the check valve 20 for throughflow. The hydraulic fluid is then carried into the inner housing 7 and distributed (in a manner not shown specifically) via the control piston 4 to the working ports A and B. The control piston 4 is pressed against the retaining ring 21 by the compression spring 18. The tank port T of the central valve 1 is formed at the screw head end of the central screw 10 by a plurality of openings 30 in the control piston 4. An end face of the control piston 4 also makes contact on this side with an actuating pin (not shown specifically) of a central magnet (not shown specifically). By the use of the central magnet or the actuating pin, the control piston 4 is moved in the direction of the spring supporting element 19 into any desired position relative to the inner housing 7, counter to the spring force of the compression spring 18, thus enabling the hydraulic fluid and the hydraulic fluid pressure to be distributed to the working ports A and B via the control edges of the control piston 4.

Figure 2:
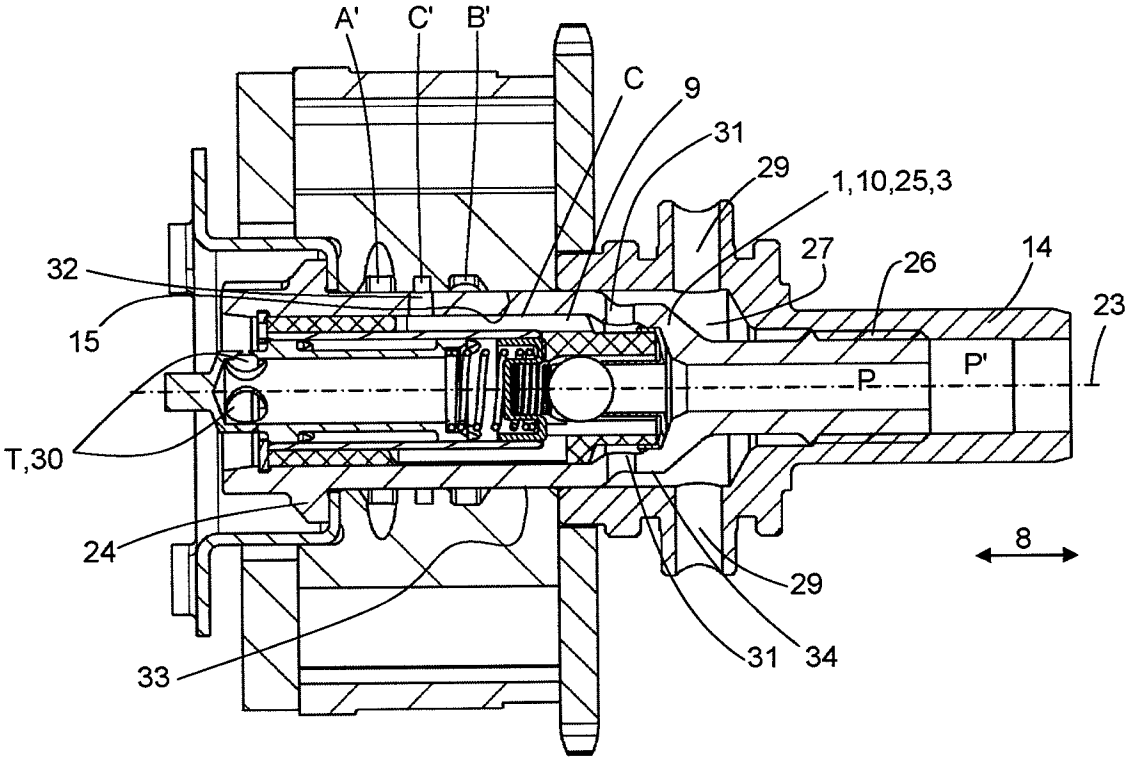
FIG. 2 shows a camshaft adjuster having another central valve according to the invention and a camshaft.

FIG. 2 shows a camshaft adjuster 2 having another central valve 1 according to the invention and a camshaft 11. Fundamentally, FIG. 2 shows a similar construction to that in FIG. 1. In the text which follows, the differences will be explained. The screw shank 25 of the central screw 10 of the central valve 1 has a constant outside diameter 33 in the region of the central opening 15, wherein, in contrast to the design according to FIG. 1, this constant outside diameter 33 extends further into the cavity 27 of the camshaft 14. The inside diameter of the central opening 15 and an inside diameter of the cavity 27 are matched to the outside diameter of the screw shank 25 in such a way that the camshaft adjuster 2 is aligned coaxially with the camshaft 14. To achieve this, the inside diameter of the central opening 15 and the inside diameter of the cavity 27 are ideally approximately the same. Using the outside diameter 33 of the screw shank 25, the cavity 27 is sealed off with respect to the camshaft adjuster 2. The central screw 10 has at least one opening 31 in the form of a bore, which is arranged in the region of the cavity 27. The outer circumferential surface of the screw shank 25, which delimits the cavity 27, is once again designed as a step 34 and adjoins the abovementioned constant outside diameter 33 of the screw shank 25 in the axial direction 8. This is followed in the axial direction 8 by the external thread 26 of the central screw 10, which, as in FIG. 1, separates the cavity 27 from interface P'.

There are multiple openings 31 arranged in a manner distributed over the circumference of the central valve 1. In this way, a high flow rate is advantageously achieved. The openings 31 open into an axial groove 9 in the inner housing 7. From the groove 9, the hydraulic fluid is passed via another opening 32 in the outer housing 3 to interface C', e.g. for use for a locking mechanism. The opening 32 is designed as a radial bore and, ideally, a plurality of such openings can be arranged in a manner distributed over the circumference. This design in accordance with the illustrative embodiment shown is advantageously suitable for the following sequence in the axial direction 8 of the interface arrangement, beginning with the end of the central opening 15 adjacent to the camshaft:

- interface B' for at least one working chamber, which advances the timings,
- interface C' for the independent passage C for independent control of a locking mechanism, for example,
- interface A' for at least one working chamber, which retards the timings.

As an alternative, interfaces B' and A' can be interchanged.

In another arrangement, the design of the groove 9 in the inner housing 7 is suitable for another, alternative sequence in the axial direction 8 of the interface arrangement, as follows, beginning with the end of the central opening 15 adjacent to the camshaft:

interface A' for at least one working chamber, which retards the timings, interface B' for at least one working chamber, which advances the timings, interface C' for the independent passage C for independent control of a locking mechanism, for example.

As an alternative, interfaces B' and A' can be interchanged.

Figure 3:
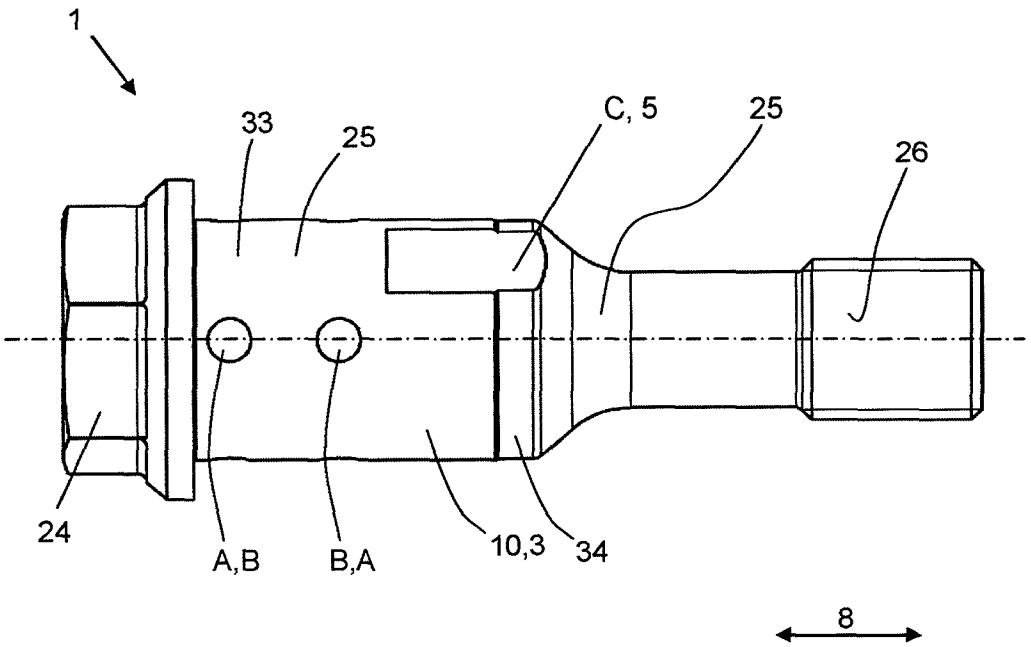
FIG. 3 shows another central valve according to the invention.

FIG. 3 shows another central valve 1 according to the invention. The independent passage C is designed as a flat 5 on the outer circumferential surface of the outer housing 3, which is designed as a central screw 10. The flat 5 overlaps the region of constant outside diameter 33, which correlates with the inside diameter of the central opening 15 of the camshaft adjuster 2, and of the step 34 which delimits the cavity 27 of the camshaft 14. The camshaft adjuster 2 and the camshaft 14 are not shown here. The working ports A and B, which are positioned as radial bores in the region of the constant outside diameter 33, are clearly visible. The radial position of the flat 5 can be chosen in such a way that reliable positioning relative to interface C' is ensured when the central valve 1 is screwed to the camshaft 14. To enhance reliable positioning, interface C' (not shown here) can be designed as an encircling groove, enabling the passage C to communicate with the encircling groove in any angular position. The flat 5 clearly extends in the axial direction 8 but with sufficient clearance relative to working port A or B to ensure that sealing is maintained between the ports.

Figure 4:
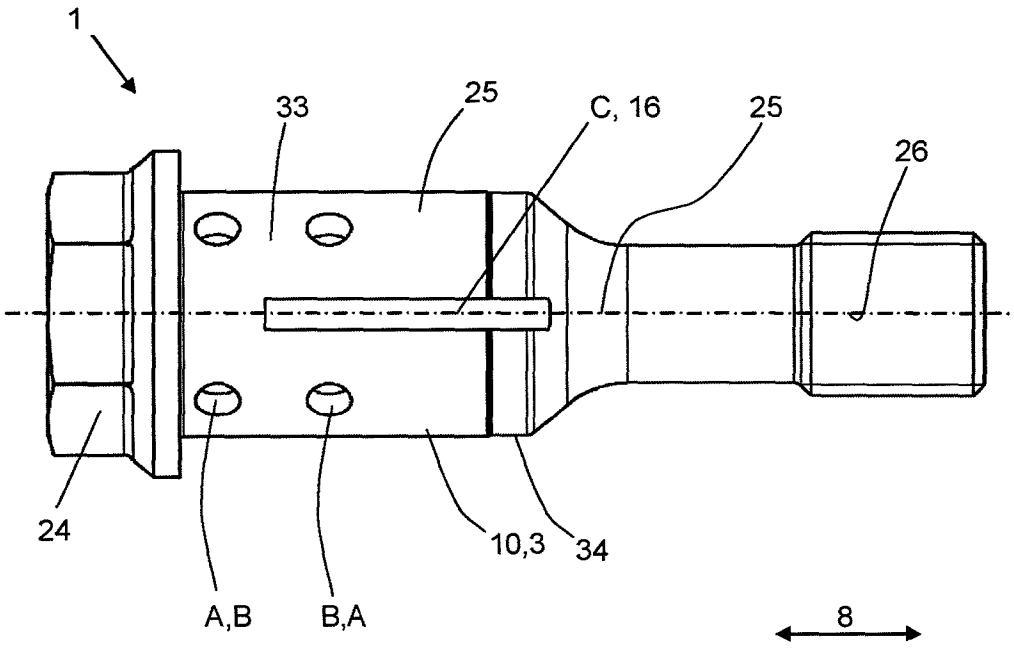
FIG. 4 shows another embodiment of the independent passage of the central valve according to the invention.

FIG. 4 shows another embodiment of the independent passage C of the central valve 1 according to the invention. The axial length of the passage C, which is designed as a groove 16, can extend approximately as far as the screw head 24. In this case, angular positioning must be provided between the central valve 1 and the camshaft adjuster 2. The throughflow cross section of the groove 16 can be constant or variable in the axial direction 8. The shape of the fluid flow cross section can be rounded, e.g. circular or elliptical, or polygonal.

LIST OF REFERENCE NUMERALS

1) central valve
2) camshaft adjuster
3) outer housing
4) control piston
5) flat
6) outer circumferential surface
7) inner housing
8) axial direction
9) groove
10) central screw
11) camshaft
12) check valve
13) opening
14) camshaft
15) central opening
16) groove
17) guide sleeve
18) compression spring
19) spring supporting element
20) check valve
21) retaining ring
22) valve seat
23) axis of rotation
24) screw head
25) screw shank
26) external thread
27) cavity
28) cavity
29) radial bore
30) opening
31) opening
32) opening
33) constant outside diameter
34) step
A) working port
B) working port
C) passage
P) inlet port
T) tank port
A') interface
B') interface
C') interface
P') interface

The invention claimed is:

1. A central valve of a camshaft adjuster, comprising:

an outer housing and a control piston arranged within the outer housing, an inflow port (P), a plurality of working ports (A, B) and a tank port (T), the control piston controls a hydraulic fluid flow from the inflow port (P) to the working ports (A, B), the central valve has an independent passage (C) for a separate hydraulic fluid flow, which does not communicate with the inflow port, the working ports or the tank port (P, A, B, T).

2. The central valve as claimed in claim 1, wherein the independent passage (C) carries hydraulic fluid irrespective of a position of the control piston.

3. The central valve as claimed in claim 1, further comprising an inner housing, which is arranged between the control piston and the outer housing, and the independent passage is in the inner housing.

4. The central valve as claimed in claim 3, wherein the inner housing has a groove extending in an axial direction, which forms the independent passage (C).

5. The central valve as claimed in claim 4, wherein an outer circumferential surface of the outer housing has an opening, which carries hydraulic fluid to the independent passage (C) of the inner housing.

6. The central valve as claimed in claim 1, wherein the outer housing of the central valve is formed as a central screw, which is adapted to connect the camshaft adjuster to a camshaft.

7. The central valve as claimed in claim 1, further comprising a check valve, which allows an inflow of hydraulic fluid in one direction of hydraulic fluid flow and prevents a flow in an opposite direction.

8. A camshaft adjuster having a central valve and a camshaft as claimed in claim 1.

9. A central valve of a camshaft adjuster, comprising: an outer housing and a control piston arranged within the outer housing, an inflow port (P), a plurality of working ports (A, B) and a tank port (T), the control piston controls a hydraulic fluid flow from the inflow port (P) to the working ports (A, B), the central valve has an independent passage (C) for a separate hydraulic fluid flow, which does not communicate with the inflow port, the working ports or the tank port (P, A, B, T), wherein the independent passage (C) is formed by the outer housing.

10. The central valve as claimed in claim 9, wherein a flat on an outer circumferential surface of the outer housing forms the independent passage (C).

* * * * *